US007484820B2

(12) United States Patent
Sugahara

(10) Patent No.: US 7,484,820 B2
(45) Date of Patent: Feb. 3, 2009

(54) RECORDING APPARATUS FOR ROTATING RECORDING MEDIUM

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 338 days.

(21) Appl. No.: 11/391,465

(22) Filed: Mar. 29, 2006

(65) Prior Publication Data

US 2006/0221102 A1 Oct. 5, 2006

(30) Foreign Application Priority Data

Mar. 30, 2005 (JP) ..... 2005-097139

(51) Int. Cl.
*B41J 25/308* (2006.01)
*B41J 3/00* (2006.01)
*B41F 17/08* (2006.01)
*B41F 17/00* (2006.01)

(52) U.S. Cl. ..... 347/8; 347/2; 347/4; 101/38.1; 101/35

(58) Field of Classification Search ..... 347/2, 347/4, 8, 12, 106, 104; 427/558; 369/30.01; 101/35, 7, 486, 38.1
See application file for complete search history.

(56) References Cited

U.S. PATENT DOCUMENTS 5,317,337 A * 5/1994 Ewaldt ..... 347/2
6,074,031 A * 6/2000 Kahle ..... 347/4
6,264,295 B1 * 7/2001 Bradshaw et al. ..... 347/2
6,902,248 B2 * 6/2005 Koguchi ..... 347/12
2006/0177597 A1 * 8/2006 Ebisawa et al. ..... 427/558
2006/0209102 A1 * 9/2006 Jones et al. ..... 347/4
2006/0221780 A1 * 10/2006 Sugahara ..... 369/30.01

FOREIGN PATENT DOCUMENTS

JP 2002046305 A 2/2002
JP 2002531290 A 9/2002
JP 2004110994 A 4/2004
WO 0032399 A1 6/2000

* cited by examiner

*Primary Examiner*—Stephen D Meier
*Assistant Examiner*—Rene Garcia, Jr.
(74) *Attorney, Agent, or Firm*—Baker Botts L.L.P.

(57) ABSTRACT

To provide a recording apparatus for recording an image on a recording medium having a flat image recording surface, the recording apparatus including: a rotary driving device which rotationally drives the recording medium; and an ink-jet head having a plurality of nozzles for ejecting ink onto the image recording surface of the recording medium, wherein each of the nozzles has an output port, and the ejection ports of the plurality of nozzles are arranged such that the distance between the ejection ports of the plurality of nozzles and the image recording surface becomes shorter toward an outer side from the rotational center of the recording medium. Accordingly, when ejecting two or more types of inks having different volumes onto a rotating recording medium, the distance between landing positions of droplets of these inks is substantially constant regardless of the positions in the recording medium.

10 Claims, 11 Drawing Sheets

RECORDING APPARATUS FOR ROTATING RECORDING MEDIUM

BACKGROUND OF THE INVENTION

1. Field of the Invention

The present invention relates to a recording apparatus for recording an image onto a recording medium having a flat image recording surface.

2. Description of the Related Art

As an apparatus for recording an image and the like onto an image recording surface, which is on the opposite side of a data recording surface for recording data in a recording medium such as a CD-R or CD-RW, there is an apparatus provided with an ink-jet head which ejects ink droplets from a nozzle onto a rotating recording medium to record an image onto a disk drive which records data into the recording medium. For example, the printing apparatus disclosed in Published Japanese Translation of PCT International Publication for Patent Application No. 2002-531290 has a rotary motor for rotating a disk and an ink-jet head provided with a plurality of nozzles arranged in a row on a radial axis. This printing apparatus drives the ink-jet head while rotating the disk by the rotary motor, and records an image on a surface of the disk by ejecting ink droplets onto the disk.

SUMMARY OF THE INVENTION

In the ink-jet head, when ink droplets are ejected from the nozzles, a satellite droplet having the volume smaller than that of a main droplet is sometimes ejected approximately simultaneously with ejection of the main droplet. In this case, the satellite droplets land on the image recording surface of the disk after the main droplet land on an image recording surface. Further, when the disk is rotated, the air in the vicinity of the surface of the disk follows the disk due to the viscosity of the air to move along the image recording surface, thus wind (airflow) in a direction along the vicinity of the image recording surface is generated in the vicinity of the image recording surface. Therefore, according to the analysis of the present inventors, when ink droplets are ejected from the nozzles of the ink-jet head onto the rotating disk as in the printing apparatus described in Published Japanese Translation of PCT International Publication for Patent Application No. 2002-531290, the main droplets and satellite droplets are flowed by the wind, thus the main droplets and the satellite droplets land on a position slightly away from a position facing the nozzles. Furthermore, in this case, since the volume of the satellite droplet is smaller than that of the main droplet, the satellite droplets are flowed away by the wind more significantly than the main droplets. Therefore, in the printing apparatus described in Published Japanese Translation of PCT International Publication for Patent Application No. 2002-531290, the landing position of the main droplet and the landing position of the satellite droplet on the image recording surface of the disk are different. In addition, the velocity of the wind generated in the vicinity of the surface of the disk increases toward the out side of the center of rotation (rotational center) of the disk, thus the difference between the distance at which the main droplet is flowed away by the wind until the main droplet lands on the image recording surface and the distance at which the satellite droplet is flowed away by the wind until the satellite droplet lands on the image recording surface, i.e. the distance between the landing position of the main droplet and of the satellite droplet, increases. When the distance between the landing positions of the two types of ink droplets with different volumes changes in accordance with the distance between the rotational center of the disk and the outside, the quality of an image recorded on the image recording surface is likely to be deteriorated.

An object of the present invention is to provide a recording apparatus capable of recording a high quality image by, when two or more types of ink droplets having different volumes are ejected on an image recording surface of a rotating recording medium, preventing the phenomenon that the distance between the landing positions of the ink droplets with different volumes is increased toward the out side of the rotational center of the recording medium.

According to an aspect of the present invention, there is provided a recording apparatus which records an image on a recording medium having a flat image recording surface, the recording apparatus including:

a rotary driving device which rotationally drives the recording medium; and an ink-jet head which has a plurality of nozzles for ejecting ink onto the image recording surface of the recording medium, the nozzles having ejection ports, wherein the ejection ports are arranged such that a distance between the ejection ports of the plurality of nozzles and the image recording surface becomes shorter toward an outer side from the rotational center of the recording medium.

According to the recording apparatus of the present invention, the time taken for the ink droplets ejected from the nozzles to land on the image recording surface of the recording medium becomes shorter toward the outer side from the rotational center of the recording medium. Further, as described above, even when the velocity of the wind in the vicinity of the surface of the recording medium increases toward the outer side from the rotational center of the recoding medium, the distance at which the ink droplets are flowed away by the wind until the ink droplets land onto the image recording surface of the recording medium becomes substantially constant regardless of the change of the distance between the position onto which the ink droplets are ejected and the rotational center of the recording medium. Therefore, the recording apparatus of the present invention can prevent the phenomenon as described above that the distance between the landing positions of the two or more types of ink droplets with different volumes on the image recording surface of the recording medium is increased toward the out side of the rotational center of the recording medium. As a result, recording of a high quality image is possible.

In the recording apparatus according to the present invention, the ink-jet head may have a flat ink ejection surface on which the ejection ports of the plurality of nozzles are formed, and the ink ejection surface may incline to the image recording surface such that the distance between the ink ejection surface and the image recording surface becomes shorter toward the outer side from the rotational center of the recording medium. According to this configuration, the simple configuration of allowing the ink ejection surface to inline to the image recording surface of the recording medium can reduce the distance between the ejection ports of the nozzles and the image recording surface toward the outer side from the rotational center of the recording medium.

Further, the recording apparatus of the present invention may further include a guide axis which supports the ink-jet head and extends from the inside of the recording medium toward the outside of the recording medium, wherein the ink-jet head may be supported by the guide axis movably along an extending direction of the guide axis, and the guide axis may incline to the image recording surface such that the distance between the guide axis and the image recording surf ace becomes shorter toward the outer side from the rotational center of the recording medium. According to this configuration, when the ink-jet head is a serial type ink-jet head, the simple configuration of allowing the guide axis to inline to the image recording surface of the recording medium can allow the ink ejection surface to incline to the image recording surface.

In the recording apparatus according to the present invention, the guide axis may incline to the image recording surface of the recording medium by 0.3 degrees.

In the recording apparatus according to the present invention, the rotary driving device may rotationally drive the recording medium at constant rotation speed.

In the recording apparatus according to the present invention, the plurality of nozzles may be provided in a row parallel to a straight line passing through a rotational centeral drive of the rotary driving device in a displaced position from the straight line. In the recording apparatus of the present invention, the ejection ports of the nozzles are disposed such that the distance between the ejection ports of the nozzles and the image recording surf ace becomes shorter toward the outer side from the rotational center of the recording medium as described above, thus the distance between the landing positions of the two or more types of ink droplets with different volumes on the image recording surface of the recording medium becomes substantially constant regardless of the positions in the image recording surfaces. However, in the case where the plurality of nozzles are disposed along the straight line passing through the rotational center of the recording medium, the wind generated in the vicinity of the image recording surface of the recording medium causes an ink droplet to land in a position slightly away from the direction toward the outer side of the rotational center of the recording medium (the straight line passing through the rotational center of the recording medium). In this case, slight distortion is likely to be generated on an image to be recorded. On the other hand, as described above, when the nozzles are arranged in the position displaced from the straight line passing through the rotational center, ink droplets land substantially on the straight line passing through the rotational center of the recording medium. Therefore, the distortion on the image can be corrected, and the quality of the image can be improved.

Furthermore, in the recording apparatus according to the present invention, the ink-jet head may selectively eject droplets having different volumes from the nozzles. According to this configuration, even when the droplets having different volumes are ejected from the nozzles to perform gradation of the droplets, there is almost no change in the distance between the landing positions of the ink droplets with different volumes regardless of the distance between the position on which the ink droplets are ejected and the rotational center of the recording medium, thus the quality of an image to be recorded on the image recording surface of the recording medium is improved.

The recording apparatus of the present invention may further include a plurality of ink-jet heads for ejecting a plurality of colors of inks respectively, wherein the plurality of ink-jet heads may be arranged in a row from the inside of the recording medium toward the outside of the recording medium. According to this configuration, in the case of recording a color image on the image recording surface of the recording medium by using the plurality of ink-jet heads for ejecting a plurality of colors of ink droplets respectively, it is possible to prevent the phenomenon that the distance between the landing positions of the ink droplets with different volumes is increased toward the outer side from the rotational center of the recording medium. Therefore, the distance between the landing positions of the ink droplets can be made substantially constant regardless of the positions in the recording medium. Accordingly, it is possible to prevent color shading on a color image which is caused by change in the distance between the landing positions of the ink droplets with different volumes depending on the positions in the recording medium during the recording of the image.

In the recording apparatus according to the present invention, the plurality of nozzles of the ink-jet heads may be divided into a plurality of groups for ejecting mutually different colors of inks respectively, and the plurality of groups may be arranged in a row from the inside of the recording medium toward the outside of the recording medium. In this case as well, when recording a color image, it is possible to prevent the phenomenon that the distance between the landing positions of the ink droplets with different volumes is increased toward the outside of the rotational center of the recording medium. Therefore, the distance between the landing positions can be made substantially constant regardless of the positions in the recording medium. As a result, the occurrence of color shading is prevented.

The recording apparatus of the present invention may further include a data-recording head for recording data onto a data recording surface which is formed on the side opposite to the image recording surface of the recording medium, wherein the ink-jet head and the data-recording head may be disposed so as to be opposite to each other with the recording medium intervening therebetween. According to this configuration, one recording apparatus can perform data recording onto the data recording surface of the recording medium and image recording onto the image recording surface of the recording medium. Moreover, the ink-jet head and the data-recording head are disposed so as to be opposite to each other with the recording medium intervening therebetween, thus ink droplets are hardly adhered to the data-recording head. Accordingly, the data-recording head hardly breaks down.

DESCRIPTION OF THE PREFERRED EMBODIMENTS

Embodiments of the present invention are described hereinafter with reference to the drawings, but the present invention is not limited to these embodiments. The present embodiment is an example in which the recording apparatus of the present invention is applied to a disk drive for recording data on an optical disk such as a CD-R and CD-RW.

Figure 1:
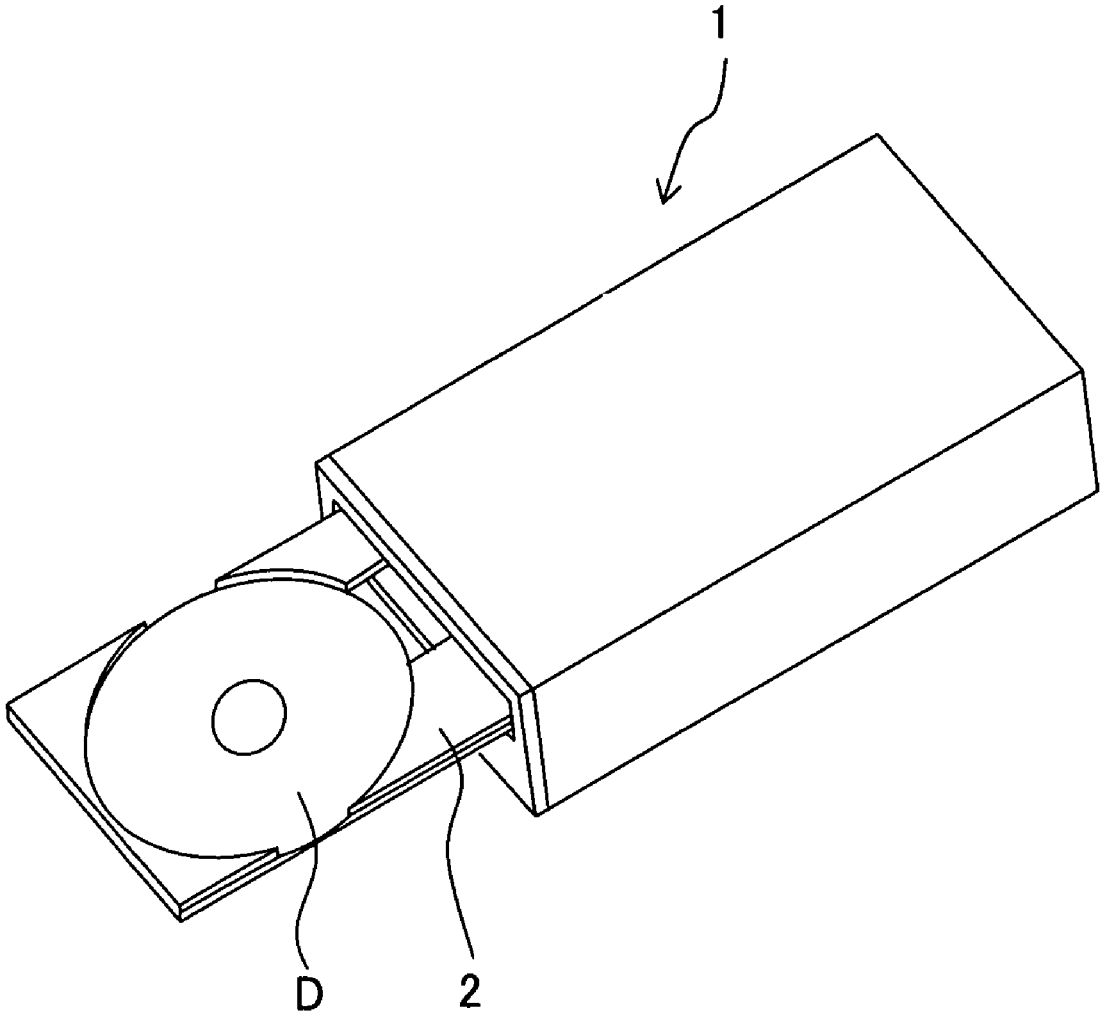
FIG. 1 is an external perspective view showing a disk drive according to an embodiment of the present invention.

FIG. 1 is an external perspective view of a disk drive 1 (recording apparatus) according to the present embodiment. As shown in FIG. 1, the chassis of the disk drive 1 is so-called half-height size, and is the same as the chassis used an ordinary CD-ROM or CD-R/RW drive. An optical disk D as a recording medium is, for example, a CD-R, CD-RW, or the like, and has the shape of a circular plate. One of the surfaces of the optical disk D is a flat image recording surface Da (see FIG. 2) for recording an image or the like, and the other surface thereof is a flat data recording surface Db (see FIG. 2) for recording data. The disk drive 1 is a recording apparatus for recording an image on the image recording surface Da of the optical disk D and recording data on the data recording surface Db. As shown in FIG. 1, the disk drive 1 is provided with a loading tray 2 for inserting the optical disk D into the disk drive 1 or taking the optical disk D out of the disk drive 1. The optical disk D is placed on the loading tray 2, facing up the image recording surface Da (the image recording surface Da is directed so as not to face the loading tray 2).

Figure 2:
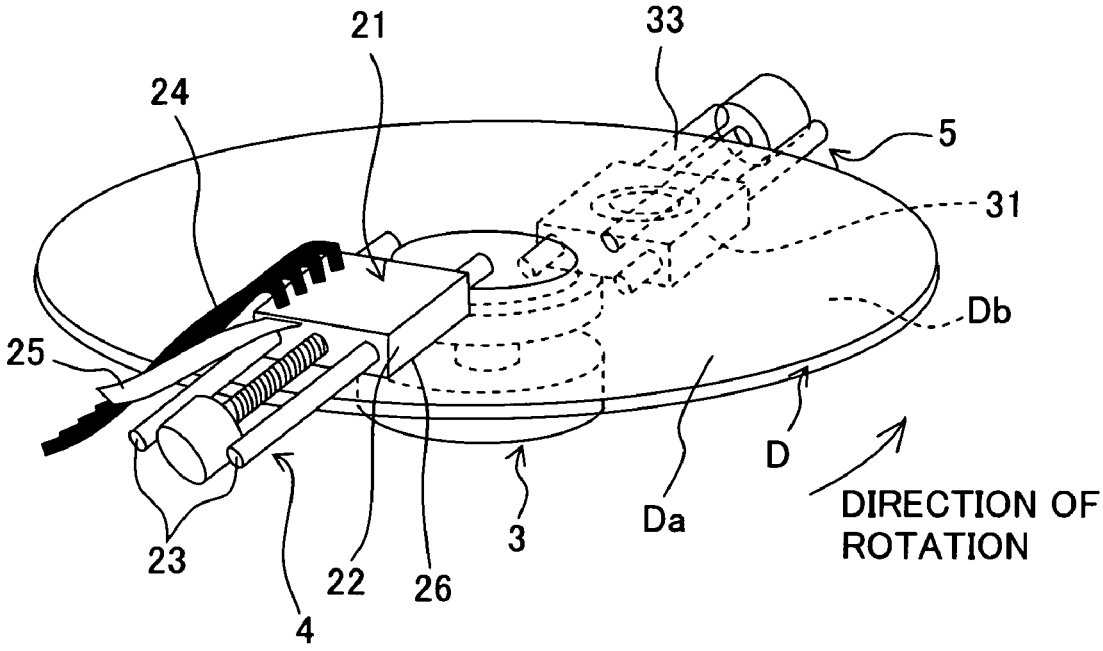
FIG. 2 is a schematic perspective view showing a state of the inside of the disk drive when a loading tray of FIG. 1 is inserted into the disk drive.

FIG. 2 is a schematic perspective view showing the inside of the disk drive 1 when the optical disk D is placed on the loading tray 2 as shown in FIG. 1 and the loading tray 2 is inserted into the disk drive 1. As shown in FIG. 2, the optical disk D is installed on a rotary driving device 3 in the disk drive 1. In this case, an image recording apparatus 4 having an ink-jet head 22 is disposed on an upper side of the image recording surface Da of the optical disk D, and an ink ejection surface 26 (see FIG. 5) of the ink-jet head 22 and the image recording surface Da face each other. A data recording apparatus 5 having a data-recording head 32 is disposed on a lower side of the data recording surface Db of the optical disk D, and a laser output surface 34 (see FIG. 5) of the data-recording head 32 and the data recording surface Db face each other. The data recording apparatus 5 is disposed in a position opposite to the image recording apparatus 4 with the optical disk D intervening therebetween, that is, the position diagonally opposite to the image recording apparatus 4 with respect to the center of the optical disk D. Specifically, the ink-jet head 22 and the data-recording head 32 are disposed so as to be symmetrical with each other with respect to the rotational center of the optical disk D. It should be noted in the illustration of FIG. 2 a part of the rotary driving device 3 is omitted.

Figure 3:
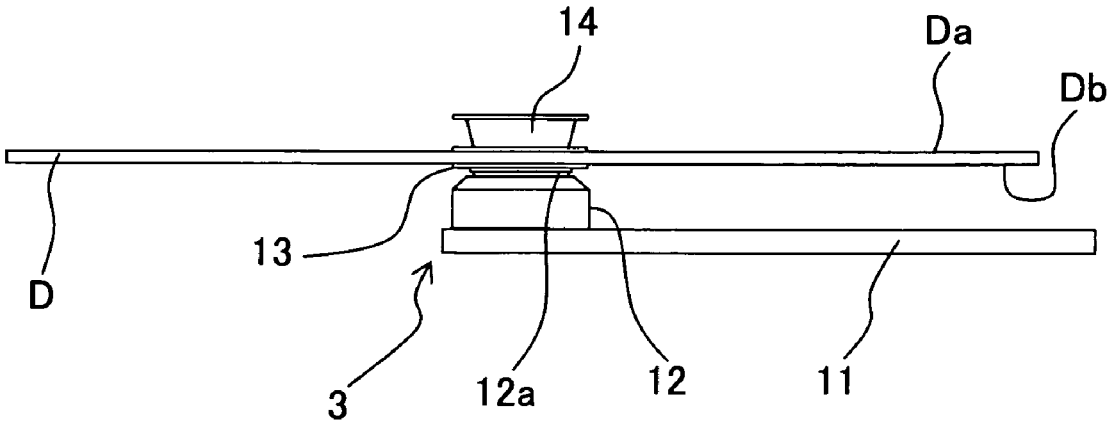
FIG. 3 is a side view showing a rotary driving device of FIG. 2.

The rotary driving device 3 is described using FIG. 3. FIG. 3 is a side view showing the rotary driving device 3 of FIG. 2. The rotary driving device 3 is a device for rotary driving the optical disk D, and a spindle motor 12 is disposed on an upper surface of a supporting member 11 as shown in FIG. 3. The spindle motor 12 has at its upper end portion a rotation axis 12*a* extending upward, and an upper end of the rotation axis 12*a* is provide with a turn table 13. Upper surface of the turn table 13 is circular and flat, and is provided so as to be perpendicular with respect the rotation axis 12*a*. The optical disk D is disposed on the upper surface of the turn table 13, facing up the image recording surface Da (the data recording surface Db is disposed so as to face the upper surface of the turn table 13). Further, a clamper 14 in which a lower surface thereof circular and flat is disposed on an upper surface of the optical disk D (the image recording surface Da), and the optical disk D is held between the turn table 13 and the clamper 14. The turn table 13 has a built-in a permanent magnet, and the clamper 14 has a built-in an iron steel piece. Therefore, when the loading disk 2 is inserted into the disk drive 1, the clamper 14 is pulled to the turn table 13 by the magnetic force and moved to the upper surface of the optical disk D. As a result, the optical disk D is held between the turn table 13 and the clamper 14. Then, the rotary driving device 3 rotates the rotation axis 12*a* of the spindle motor 12 to rotate the turn table 13 and the clamper 14, whereby the optical disk D held therebetween is rotary driven.

Figure 4:
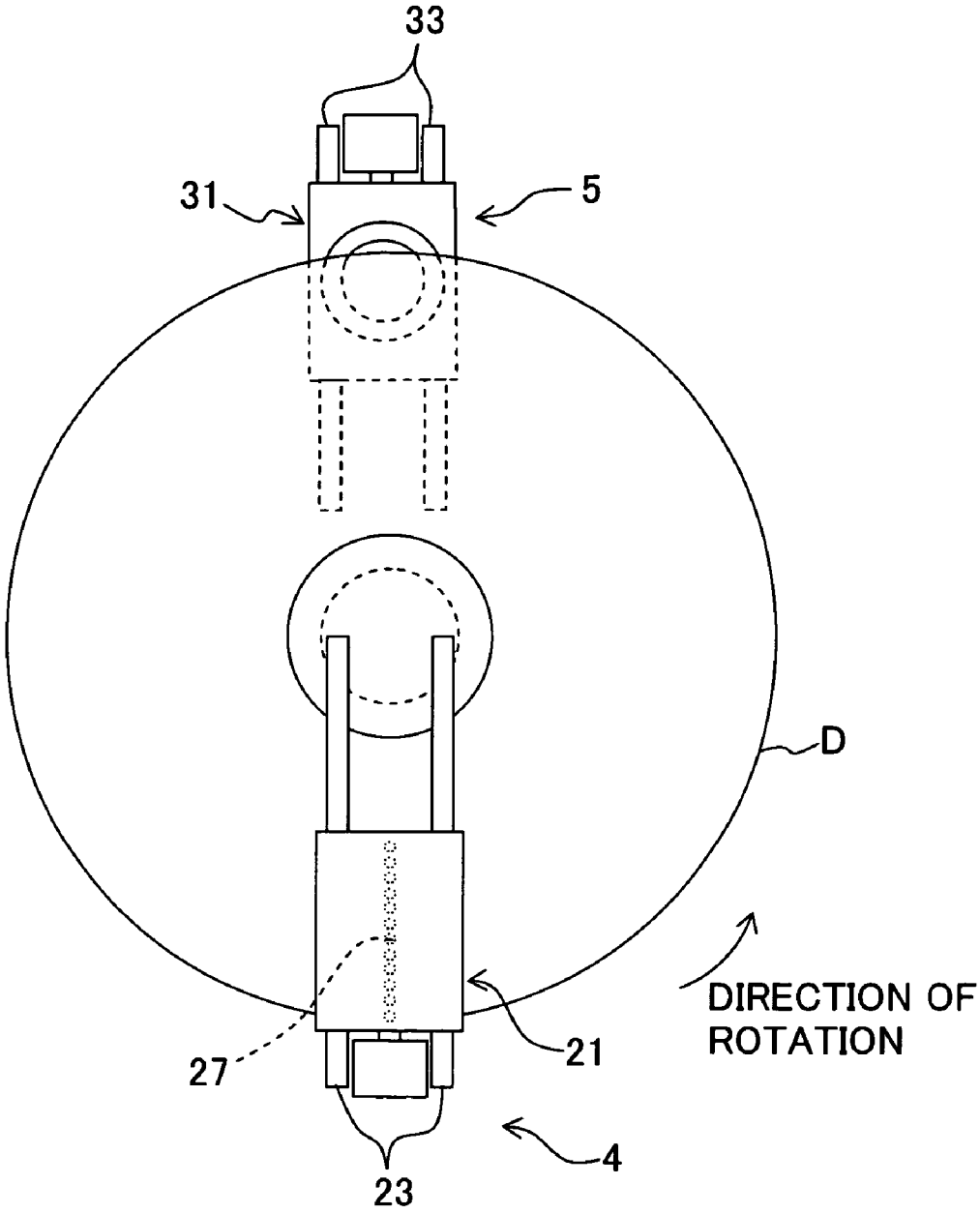
FIG. 4 is a plan view showing an image recording apparatus and a data recording apparatus of FIG. 2.
Figure 5:
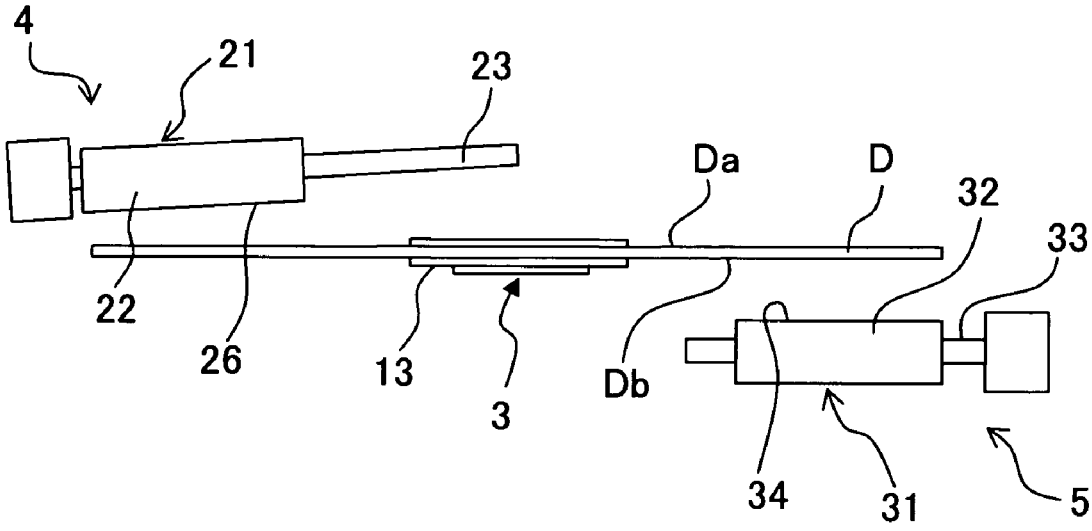
FIG. 5 is a side view showing the image recording apparatus and the data recording apparatus of FIG. 2.

Next, the image recording apparatus 4 is described using FIG. 2, FIG. 4, and FIG. 5. FIG. 4 is a plan view showing the image recording apparatus 4 and data recording apparatus 5 illustrated in FIG. 2, and FIG. 5 is a side view showing the image recording apparatus 4 and data recording apparatus 5 illustrated in FIG. 2. However, FIG. 4 and FIG. 5 show only a part of the rotary driving device 3.

As shown in FIG. 2, FIG. 4, and FIG. 5, the image recording apparatus 4 has a carriage 21 including the ink-jet head 22, two guide axes 23 supporting the carriage 21, an ink supply tube 24, and a FFC (flexible flat cable) 25. The carriage 21 is supported together with the ink-jet head 22 movably along the two guide axes 23. The two guide axes 23 are cylindrical rod-like bodies and are disposed parallel to each other. The two guide axes 23 extend in the radial direction of the optical disk D. The two guide axes 23 are inclined to the image recording surface Da such that the distance between the guide axes and the image recording surface Da of the optical disk D becomes shorter toward the outer side from the rotational center of the optical disk D.

The ink-jet head 22 is a serial type ink-jet head and has a plurality of nozzles 27 ejecting ink droplets onto the image recording surface Da of the optical disk D. A lower surface of the ink-jet head 22 (surface on the optical disk D side) is a flat ink ejection surface 26 which is parallel to the extending direction of the guide axes 23, and a large number of ejection ports of the nozzles 27 are formed in a row on the ink ejection surface 26, along the radial direction of the optical disk D (the direction of a straight line passing through the center of rotary drive of the rotary driving device). It should be noted that FIG. 4 shows only 12 nozzles of the nozzles 27 in order to simplify the illustration.

In the present embodiment, as described above, since the ink ejection surface 26 of the ink-jet head 22 is parallel to the extending direction of the guide axes 23 and the guide axes 23 are tilted, the ink ejection surface 26 inclines to the image recording surface Da of the optical disk D such that the distance between the ink ejection surface 26 and the image recording surface Da becomes shorter toward the outer side from the rotational center of the optical disk D. Accordingly, the ejection ports of the plurality of nozzles 27 provided on the ink ejection surface 26 are also disposed such that the distance between the ejection ports and the image recording surface Da of the optical disk D become shorter toward the outer side from the rotational center of the optical disk D.

In the present embodiment, when the ink-jet head 22 is moved along the guide axes 23 to the position in which the distance between the ink-jet head 22 and the rotational center of the optical disk D becomes shortest (innermost circumferential position), the distance between the ink ejection surface 26 and the image recording surface Da of the optical disk D, at the position of the ink ejection surface 26 (a right end of the ink ejection surface 26 as illustrated in FIG. 5) in which the distance between the ink ejection surface 26 and the rotational center of the optical disk D is shortest, is set to 1.2 mm. Further, when the ink-jet head 22 is moved along the guide axes 23 to the position in which the distance between the ink-jet head 22 and the rotational center of the optical disk D becomes longest (outermost circumferential position), the distance between the ink ejection surface 26 and the image recording surface Da of the optical disk D, at the position of the ink ejection surface 26 (a left end of the ink ejection surface 26 as illustrated in FIG. 5) in which the distance between the ink ejection surface 26 and the rotational center of the optical disk D becomes longest, is set to 0.8 mm. In addition, as described hereinafter, in the disk drive 1 of the present embodiment, a nozzle position on the innermost circumferential side (radial position) of the optical ink-jet head 22 is 42 mm away from the center of the optical disk D when the ink-jet head 22 is moved to the innermost circumferential position of the optical disk D, and a nozzle position on the outermost circumferential side of the optical ink-jet head 22 is 118 mm away from the center of the optical disk D when the ink-jet head 22 is moved to the outermost circumferential position of the optical disk D. The angle of inclination of the guide axes with respect to the image recording surface Da of the optical disk D can be calculated based on the relationship of the nozzle positions and the distance between the ink ejection surface 26 and the image recording surface Da when the ink-jet head 22 is moved to the outermost circumferential position and the innermost circumferential position. In the disk drive of the present embodiment, the angle of inclination of the guide axes is approximately 0.3.

The ink supply tube 24 is connected the ink-jet head 22 and an ink tank which is not shown. Ink is supplied from the ink tank to the ink-jet head 22 via the ink supply tube 24. The FFC 25 is connected to an actuator (not shown) of the ink-jet head 22 and drive voltage is applied from an unshown driver IC provided on an upper side of the FFC 25 to the actuator. The drive voltage is applied to the actuator and the pressure is applied to an unshown pressure chamber communicated to each of the plurality of nozzles 27, whereby the ink-jet head 22 ejects ink droplets from the nozzles 27. In this manner, the ink-jet head 22 moves in the radial direction of the optical disk D along the guide axes 23 while ejecting the ink droplets from the nozzles 27 onto the image recording surface Da, thereby recording an image. In addition, control of the position of the ink-jet head is performed by an unshown encoder inside the disk drive 1.

Next, the data recording apparatus 5 is described using FIG. 2, FIG. 4, and FIG. 5. As shown in FIG. 2, FIG. 4, and FIG. 5, the data recording apparatus 5 includes a carriage 31 and two guide axes 33. The carriage 31 has the data-recording head 32, is supported along with the data-recording head 32 by the two guide axes 33, and is supported movably along the extending direction of the guide axes 33. An upper surface of the data-recording head 32 (a surface facing the data recording surface Db of the optical disk D) is the laser output surface 34 which is parallel to the data recording surface Db, and a laser beam can be emitted from the laser output surface 34 to the data recording surface Db. The two guide axes 33 are cylindrical rod-like bodies parallel to each other, extend from the inside toward the outside of the optical disk D, that is, in the radial direction of the optical disk D, and are disposed so as to be parallel to the data recording surface Db. The data-recording head 32 emits a laser beam from the laser output surface 34 to the data recording surface Db to record data, while moving in the radial direction of the optical disk D along the guide axes 33. It should be noted that, when the data recording apparatus 5 records data onto the data recording surface Db after the image recording apparatus 4 records an image onto the image recording surface Da of the optical disk D, the center of gravity of the optical disk D is shifted by an ink droplet adhered to the image recording surface Da, whereby a writing error or the like is likely to occur at time of data recording. Therefore, writing of data onto the data recording surface Db by means of the data recording apparatus 5 is preferably performed before recording of an image onto the image recording surface Da by means of the image recording apparatus 4.

Figure 6:
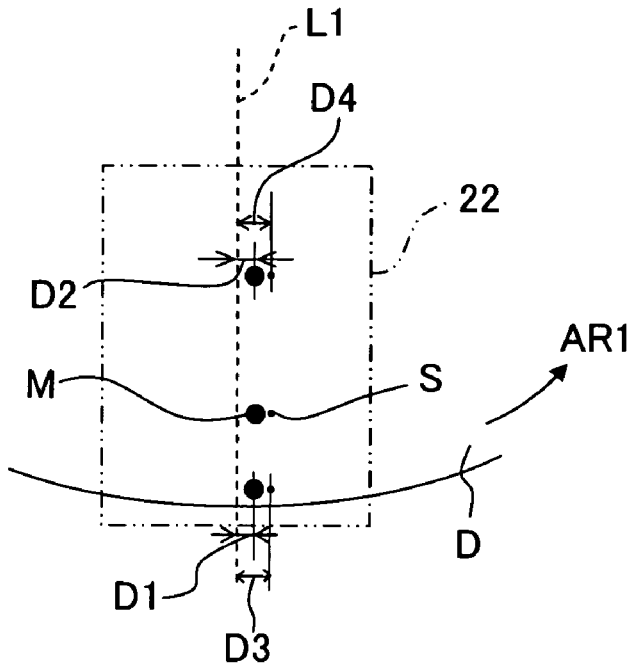
FIG. 6 is a plan view showing the relationship between the landing positions of a main droplet and a satellite droplet when the ink droplets are ejected onto a recording medium by using a recording apparatus of the embodiment of the present invention.
Figure 13:
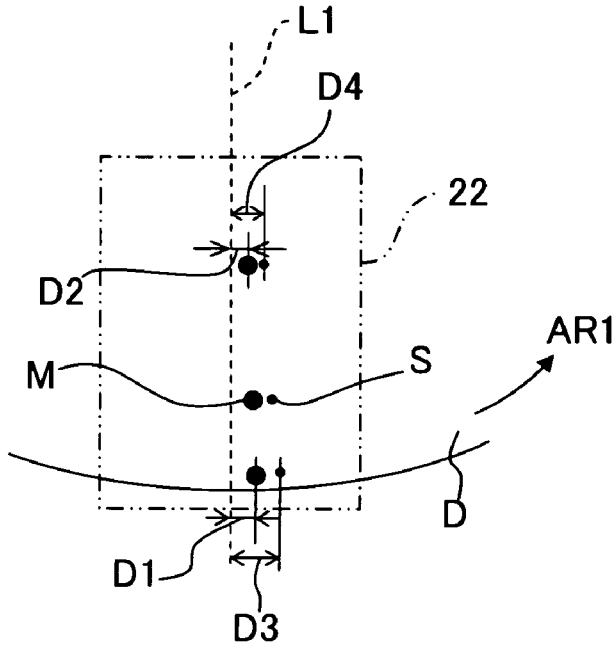
FIG. 13 is a plan view showing the relationship between the landing positions of a main droplet and a satellite droplet when the ink droplets are ejected onto a recording medium by using a conventional recording apparatus.

Here, ink droplets ejected onto the image recording surface Da of the optical disk D from the nozzles 27 of the ink-jet head 22 are described using FIG. 6 and FIG. 13. FIG. 6 shows landing positions of landed ink droplets on the image recording surface Da in the case where the ink is ejected from the nozzles 27 with the disk drive 1 of the present embodiment. FIG. 13 shows landing positions of landed ink droplets on the image recording surface Da in the case where the ink is ejected with a conventional disk drive, that is, a disk drive in which an ink ejection surface of the ink-jet head and the image recording surface Da of the optical disk D are parallel to each other. It should be noted that the two-dot chain lines in FIGS. 6 and 13 indicate the positions of the ink-jet head 22 when the ink droplets are ejected from the nozzles 27. A straight line L1 in each of FIGS. 6 and 13 is a straight line passing through the center of the optical disk D, and the plurality of nozzles 27 are disposed on this straight line. An arrow AR 1 in each of FIGS. 6 and 13 indicates the direction of rotation of the optical disk D.

When ink droplets are ejected from the nozzles 27, an ejected ink droplet forms a columnar shape and flies so as to leave traces, and the speed difference is generated between a head portion and a tail portion of the flying ink droplet. For this reason, following a main droplet M which is a preceding ink droplet, a satellite droplet S, which is an ink droplet having volume smaller than that of the main droplet, is generated. In this case, since the optical disk D is rotated, the air in the vicinity of the image recording surface Da follows the optical disk D due to the viscosity of the air to move along the image recording surface Da. Specifically, in the vicinity of the image recording surface Da, wind is generated in the direction of rotation of the optical disk D (the direction of the arrow AR 1 shown in FIGS. 6 and 13) and in the direction parallel to the image recording surface. Therefore, the main droplet M and the satellite droplet S are caused to flow in the direction of rotation of the optical disk D by this wind. For this reason, the actual landing positions of the main droplet M and the satellite droplet S on the image recording surface Da are shifted in the direction of rotation of the optical disk D from designed landing positions (positions of points which are projected the ejection ports of the nozzles 27 onto the image recording surface Da of the optical disk D from the direction perpendicular to the ink ejection surface 26 (positions of points on the straight line L1 in FIGS. 6 and 13)). Since the weight of the satellite droplet S is smaller than that of the main droplet M, the inertial force acting on the satellite droplet S is smaller than the inertial force acting on the main droplet M. Therefore, the shifted amount of the landing position of the satellite droplet S becomes larger than that of the main droplet M.

Further, since the wind speed becomes larger toward the outer edge of the optical disk D, in the case where the ink ejection surface 26 of the ink-jet head 22 and the image recording surface Da of the optical disk D are parallel to each other as in the conventional disk drive, the shifted amounts of the landing positions of the main droplet M and the satellite droplet S become larger toward the outer edge of the optical disk D, as shown in FIG. 13. Specifically, in the conventional disk drive, a shifted amount D1 of a landing position of the main droplet M in the vicinity of the outer edge of the optical disk D is larger than a shifted amount D2 of a landing position of the main droplet M in the vicinity of the center between the rotational center and the outer edge of the optical disk D (D1>D2), and a shifted amount D3 of a landing position of the satellite droplet S in the vicinity of the outer edge of the optical disk D (D3>D1) is larger than a shifted amount D4 (D4>D2) of a landing position of the satellite droplet S in the vicinity of the center between the rotational center and the outer edge of the optical disk D (D3>D4).

On the other hand, in the case where the distance between the ink ejection surface 26 of the ink-jet head 22 and the image recording surface Da of the optical disk D becomes smaller toward the outer edge of the optical disk D as in the disk drive 1 of the present embodiment, flying time of an ink droplet which is ejected from the nozzle 27 becomes shorter toward the outer edge of the optical disk D, thus the distance in which ink droplets are flowed by the wind generated in the vicinity of the image recording surface Da can be reduced in the vicinity of the outer edge of the optical disk D. Therefore, by appropriately adjusting the angle of inclination of the ink ejection surface 26 with respect to the image recording surface Da, the shifted amounts of the landing positions of the main droplet M and the satellite droplet S can be made constant regardless of the positions in the optical disk D, as shown in FIG. 6. Specifically, the shifted amount D1 of the landing position of the main droplet M in the vicinity of the outer edge of the optical disk D can be made substantially equal to the shifted amount D2 of the landing position of the main droplet M in the vicinity of the center between the rotational center and the outer edge of the optical disk D (D1≈D2), and the shifted amount D3 (D3>D1) of the landing position of the satellite droplet S in the vicinity of the outer edge of the optical disk D can be made substantially equal to the shifted amount D4 (D4>D2) of the landing position of the satellite droplet S in the vicinity of the center between the rotational center and the outer edge of the optical disk D (D3≈D4). In other words, the distance between the landing positions of the main droplet M and the satellite droplet S which are ejected almost simultaneously from a single nozzle 27 can be made substantially equal in any positions in the optical disk D.

In addition, the relationship between the shifted amounts of landing positions of the main droplet M and the satellite droplet S on the image recording surface Da of the optical disk D when the disk drive 1 of the present embodiment is used was examined through numerical analysis. Results of the examination are shown in Table 1. In addition, results of the analysis when using the conventional disk drive (device in which the ink ejection surface 26 is parallel to the image recording surface Da) are shown in Table 2 for comparison.

Table 1 and Table 2 show the shifted amounts of the landing positions of the main droplet M and the satellite droplet S from the designed landing positions of same when inks are ejected respectively from a nozzle 27 located proximate to the rotational center of the optical disk D and a nozzle 27 located farthest from the rotational center of the optical disk D, in the case where the ink-jet head 22 is in the innermost circumferential position of the optical disk D and in the case where the ink-jet head 22 is in the outermost circumferential position of the optical disk D. In addition, Table 2 shows results of the case where the distance between the ink ejection surface 26 and the image recording surface Da is 1.0 mm.

Table 1 and Table 2 show the distance Xi between the nozzle 27 located proximate to the rotational center of the optical disk D and the rotational center of the optical disk D in a plan view, the wind speed Vi in the position of the nozzle 27 located the distance Xi, and the shifted amount Aim of main droplet M from a position on which the ink droplet is ejected, the shifted amount Ais of satellite droplet S from a position on which the ink droplet is ejected and the distance Aid between the landing positions of the main droplet M and the satellite droplet S, when the ink droplets are ejected from the nozzle 27 located proximate to the rotational center of the optical disk D. Furthermore, Table 1 and Table 2 show the distance Xo between the nozzle 27 located farthest from the rotational center of the optical disk D and the rotational center of the optical disk D in a plan view, the wind speed Vo in the position of the nozzle 27 located the distance Xo, the shifted amount Aom of main droplet M from a position on which the ink droplet is ejected, the shifted amount Aos of satellite droplet S from a position on which the ink droplet is ejected, and the distance Aod between the landing positions of the main droplet M and the satellite droplet S, when the ink droplets are ejected from the nozzle 27 located farthest from the rotational center of the optical disk D.

A condition for the numerical analysis is that the external diameter of the optical disk D is 120 mm and the angular speed ω (the rotation speed) of the optical disk D is kept to be constant at about 9.2 rad/sec. The angle of inclination of the ink-jet head 22 with respect to the optical disk D in the recording apparatus of the present embodiment is set to approximately 0.3 degrees as described above. In addition, the ejection speed for the main droplet M is 8 m/s, the volume of the main droplet M is 5 pl, the ejection speed for the satellite droplet S is 7 m/s, and the volume of the satellite droplet S is 1 pl.

TABLE 1

| | | When the head is located at the innermost circumferential position | When the head is located at the outermost circumferential position |
|---|---|---|---|
| Nozzle position | Xi (mm) | 42 | 98 |
| | Xo (mm) | 62 | 118 |
| Wind speed | Vi (m/s) | 0.39 | 0.91 |
| | Vo (m/s) | 0.57 | 1.09 |
| Shifted amount of main droplet | Aim (μm) | 6 | 8 |
| | Aom (μm) | 8 | 7 |
| Shifted amount of satellite droplet | Ais (μm) | 34 | 38 |
| | Aos (μm) | 39 | 36 |
| Distance between landing positions of main droplet and satellite droplet | Aid (μm) | 28 | 30 |
| | Aod (μm) | 31 | 29 |

TABLE 2

| | | When the head is located at the innermost circumferential position | When the head is located at the outermost circumferential position |
|---|---|---|---|
| Nozzle position | Xi (mm) | 42 | 98 |
| | Xo (mm) | 62 | 118 |
| Wind speed | Vi (m/s) | 0.39 | 0.91 |
| | Vo (m/s) | 0.57 | 1.09 |
| Shifted amount of main droplet | Aim (μm) | 4 | 10 |
| | Aom (μm) | 6 | 11 |
| Shifted amount of satellite droplet | Ais (μm) | 21 | 48 |
| | Aos (μm) | 30 | 60 |
| Distance between landing positions of main droplet and satellite droplet | Aid (μm) | 17 | 38 |
| | Aod (μm) | 24 | 49 |

In the case of the present embodiment, as is clear from Table 1, the distances Aid and Aod between the landing positions of the main droplets M and the satellite droplets S, which are ejected respectively from the nozzle 27 located proximate to the rotational center of the optical disk D and from the nozzle 27 located farthest from the rotational center of the optical disk D when the ink-jet head 22 is located at the innermost circumferential position, are, respectively, 28 μm and 31 μm. Further, the distances Aid and Aod between the landing positions of the main droplets M and the satellite droplets S when the ink-jet head 22 is located at the outermost circumferential position are, respectively, 30 μm and 29 μm. On the other hand, in the case of the conventional disk drive in which the ink ejection surface 26 and the image recording surface Da are parallel to each other, as is clear from Table 2, the distances Aid and Aod between the landing positions of the main droplets M and the satellite droplets S when the ink-jet head 22 is located at the innermost circumferential position are, respectively, 17 μm and 24 μm. The distances Aid and Aod between the landing positions of the main droplets M and the satellite droplets S when the ink-jet head 22 is located at the outermost circumferential position are, respectively, 38 μm and 49 μm. According to these results, it is appreciated that the distances between the landing positions of the main droplets M and the satellite droplets S when the disk drive 1 of the present embodiment is used, are substantially equal regardless of the positions in the optical disk D.

As described above, in the disk drive of the present embodiment, the distances between the landing positions of the main droplets M and the satellite droplets S are substantially equal regardless of the positions in the optical disk D, thus noises on an image to be printed can be reduced and the quality of the image can be improved.

Figure 7:
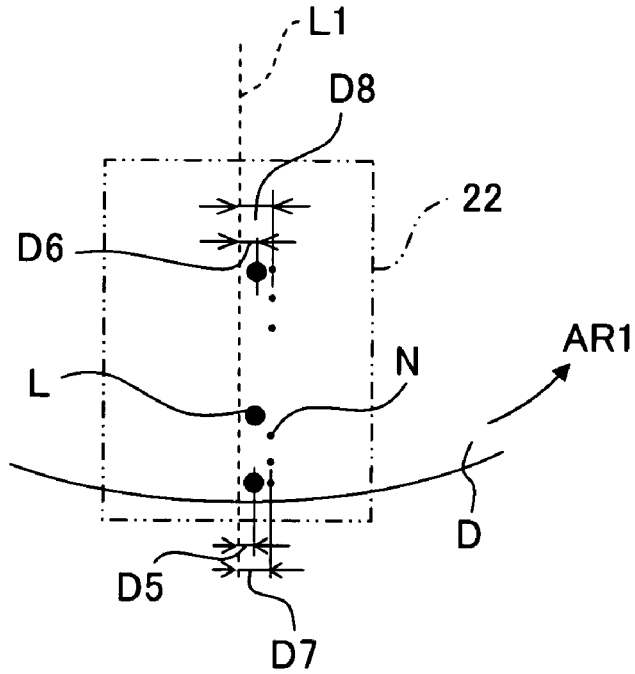
FIG. 7 is a plan view showing the relationship between the landing positions of a large droplet and a small droplet when ejecting the ink droplets onto a recording medium by using a recording apparatus of the embodiment of the present invention.
Figure 14:
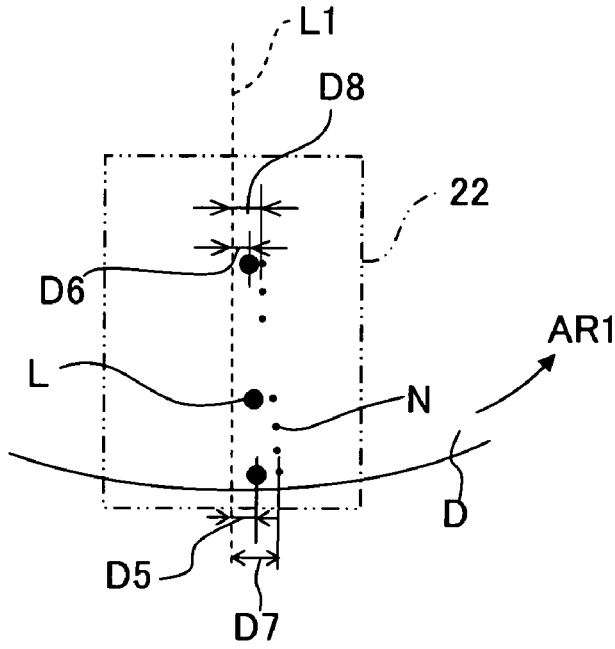
FIG. 14 is a plan view showing the relationship between the landing positions of a large droplet and a small droplet when the ink droplets are ejected onto a recording medium by using the conventional recording apparatus.

In addition, the ink-jet head 22 can simultaneously eject ink droplets having different volumes from the nozzles 27 in accordance with the area of a section which is recorded an image, and perform gradation of the droplets. In this embodiment, it is described the landing positions of ink droplets in a case in which two types of ink droplets (large droplet L and small droplet N) having different volumes are ejected simultaneously and selectively to perform droplet gradation. FIG. 7 shows the relationship between the landing positions of two types of ink droplets (large droplet L and small droplet N) having different volumes when the large droplet L and the small droplet N are ejected onto the image recording surface Da of the optical disk D with the disk drive of the present embodiment. Further, FIG. 14 shows the relationship between the landing positions of two types of ink droplets (large droplet L and small droplet N) having different volumes when the large droplet L and the small droplet N are ejected onto the image recording surface Da of the optical disk D with the conventional disk drive (the device in which the ink ejection surface 26 and the image recording surface Da are parallel to each other). It should be noted that the two-dot chain lines in FIGS. 7 and 14 indicate the positions of the ink-jet head 22 when the ink droplets are ejected from the nozzles 27. A straight line L1 in each of FIGS. 7 and 14 is a straight line passing through the center of the optical disk D, and the plurality of nozzles 27 are disposed on this straight line. An arrow AR 1 in each of FIGS. 7 and 14 indicates the direction of rotation of the optical disk D.

When the large droplet L and small droplet N are simultaneously ejected from the nozzles 27, since the optical disk D is rotated, the air in the vicinity of the image recording surface Da follows the optical disk D due to the viscosity of the air to move along the image recording surface Da, as in the same manner described above (as described in the case in which the main droplet and the satellite droplet are ejected from the nozzles), and then wind is generated in the vicinity of the image recording surface Da. Therefore, in the case where the large droplet L and small droplet N are simultaneously ejected from the nozzles 27 as well, the large droplet L and small droplet N are caused to flow in the direction of rotation of the optical disk D by this wind. For this reason, the landing positions of the large droplet L and the small droplet N on the image recording surface Da are shifted in the direction of rotation of the optical disk D from designed landing positions. Since the weight of the small droplet N is smaller than that of the large droplet L, the inertial force acting on the small droplet N is smaller than the inertial force acting on the large droplet L. Therefore, the shifted amount of the landing position of the small droplet N becomes larger than that of the large droplet L.

Further, since the speed of the wind generated in the vicinity of the image recording surface Da becomes larger toward the outer edge of the optical disk D, in the case where the ink ejection surface 26 of the ink-jet head 22 and the image recording surface Da of the optical disk D are parallel to each other as in the conventional disk drive, the shifted amounts of the landing positions of the large droplet L and the small droplet N become larger toward the outer edge of the optical disk D, as shown in FIG. 14. Specifically, in the conventional disk drive, a shifted amount D5 of a landing position of the large droplet L in the vicinity of the outer edge of the optical disk D is larger than a shifted amount D6 of a landing position of the large droplet L in the vicinity of the center between the rotational center and the outer edge of the optical disk D (D5>D6), and a shifted amount D7 of a landing position of the small droplet N in the vicinity of the outer edge of the optical disk D (D7>D5) is larger than a shifted amount D8 (D8>D6) of a landing position of the small droplet N in the vicinity of the center between the rotational center and the outer edge of the optical disk D (D7>D8).

On the other hand, in the case where the distance between the ink ejection surface 26 of the ink-jet head 22 and the image recording surface Da of the optical disk D becomes smaller toward the outer edge of the optical disk D as in the disk drive of the present embodiment, flying time of an ink droplet which is ejected from the nozzle 27 becomes shorter toward the outer edge of the optical disk D, thus the distance in which ink droplets are flowed by the wind generated in the vicinity of the image recording surface Da can be reduced in vicinity of the outer edge of the optical disk D. Therefore, by appropriately adjusting the angle of inclination of the ink ejection surface 26 with respect to the image recording surface Da, the shifted amounts of the landing positions of the large droplet L and the small droplet N can be made constant regardless of the positions in the optical disk D, as shown in FIG. 7. Specifically, the shifted amount D5 of the landing position of the large droplet L in the vicinity of the outer edge of the optical disk D can be made substantially equal to the shifted amount D6 of the landing position of the large droplet L in the vicinity of the center between the rotational center and the outer edge of the optical disk D (D5≈D6), and the shifted amount D7 (D7>D5) of the landing position of the small droplet N in the vicinity of the outer edge of the optical disk D can be made substantially equal to the shifted amount D8 (D8>D6) of the landing position of the small droplet N in the vicinity of the center between the rotational center and the outer edge of the optical disk D (D7≈D8). In other words, the distance between the landing positions of the large droplet L and the small droplet N which are ejected almost simultaneously from one of nozzles 27 can be made substantially constant in any positions in the optical disk D.

In addition, the relationship between the shifted amounts of landing positions of the large droplet L and the small droplet N on the image recording surface Da of the optical disk D when the disk drive 1 of the present embodiment is used was examined through numerical analysis. Results of the examination are shown in Table 3. In addition, results of the analysis when using the conventional disk drive (device in which the ink ejection surface 26 is parallel to the image recording surface Da) are shown in Table 4 for comparison. Table 3 and Table 4 show the shifted amounts of the landing positions of the large droplet L from the small droplet N on the image recording surface Da and the designed landing positions of same when the inks are ejected respectively from a nozzle 27 located proximate to the rotational center of the optical disk D and a nozzle 27 located farthest from the rotational center of the optical disk D, in the case where the ink-jet head 22 is in the innermost circumferential position of the optical disk D and in the case where the ink-jet head 22 is in the outermost circumferential position of the optical disk D. In addition, Table 4 shows results of the case where the distance between the ink ejection surface 26 and the image recording surface Da is 1.0 mm.

Table 3 and Table 4 show the distance Xi between the nozzle 27 located proximate to the rotational center of the optical disk D and the rotational center of the optical disk D in a plan view, the wind speed Vi in the position of the nozzle 27 located the distance Xi, and the shifted amount Ail of large droplet L from a position on which the ink droplet is ejected, the shifted amount Ain of small droplet N from a position on which the ink droplet is ejected, and the distance Aie between the landing positions of the large droplet L and the small droplet N, when the ink droplets are ejected from the nozzle 27 located proximate to the rotational center of the optical disk D. Furthermore, Table 3 and Table 4 show the distance Xo between the nozzle 27 located farthest from the rotational center of the optical disk D and the rotational center of the optical disk D in a plan view, the wind speed Vo in the position of the nozzle 27 located the distance Xo, and the shifted amount Aol of large droplet L from a position on which the ink droplet is ejected, the shifted amount Aon of small droplet N from a position on which the ink droplet is ejected and the distance Aoe between the landing positions of the large droplet L and the small droplet N, when the ink droplets are ejected from the nozzle 27 located farthest from the rotational center of the optical disk D.

In the case where ejecting the large droplet L and small droplet N are simultaneously ejected, a condition for the numerical analysis is that the external diameter of the optical disk D is 120 mm and the angular speed ω (rotation speed) of the optical disk D is kept to be constant at about 9.2 rad/sec. The angle of inclination of the ink-jet head 22 with respect to the optical disk D in the recording apparatus of the present embodiment is set to approximately 0.3 degrees as described above. In addition, the ejection speed for the large droplet L and for the small droplet N is 8 m/s, the volume of the large droplet L is 5 pl, and the volume of the small droplet N is 1.5 pl.

TABLE 3

| | | When the head is located at the innermost circumferential position | When the head is located at the outermost circumferential position |
|---|---|---|---|
| Nozzle position | Xi (mm) | 42 | 98 |
| | Xo (mm) | 62 | 118 |
| Wind speed | Vi (m/s) | 0.39 | 0.91 |
| | Vo (m/s) | 0.57 | 1.09 |
| Shifted amount of large droplet | Ail (μm) | 6 | 8 |
| | Aol (μm) | 8 | 7 |
| Shifted amount of small droplet | Ain (μm) | 16 | 19 |
| | Aon (μm) | 19 | 18 |
| Distance between landing positions of large droplet and small droplet | Aie (μm) | 10 | 11 |
| | Aoe (μm) | 11 | 11 |

TABLE 4

| | | When the head is located at the innermost circumferential position | When the head is located at the outermost circumferential position |
|---|---|---|---|
| Nozzle position | Xi (mm) | 42 | 98 |
| | Xo (mm) | 62 | 118 |
| Wind speed | Vi (m/s) | 0.39 | 0.91 |
| | Vo (m/s) | 0.57 | 1.09 |
| Shifted amount of large droplet | Ail (μm) | 4 | 10 |
| | Aol (μm) | 6 | 11 |
| Shifted amount of small droplet | Ain (μm) | 10 | 24 |
| | Aon (μm) | 15 | 29 |
| Distance between landing positions of large droplet and small droplet | Aie (μm) | 6 | 14 |
| | Aoe (μm) | 9 | 18 |

In the case of the present embodiment, as is clear from Table 3, the distances Aie and Aoe between the landing positions of the large droplets L and the small droplets N, which are ejected respectively from the nozzle 27 located proximate to the rotational center of the optical disk D and from the nozzle 27 located farthest from the rotational center of the optical disk D in the case where the ink-jet head 22 is located at the innermost circumferential position, are 10 μm and 11 μm respectively. Further, the distances Aie and Aoe between the landing positions of the large droplets L and the small droplets N when the ink-jet head 22 is located at the outermost circumferential position, are 11 μm and 11 μm respectively. On the other hand, in the case of the conventional disk drive in which the ink ejection surface 26 and the image recording surface Da are parallel to each other, as is clear from Table 4, the distances Aie and Aoe between the landing positions of the large droplets L and the small droplets N when the ink-jet head 22 is located at the innermost circumferential position, are 6 μm and 9 μm respectively. The distances Aie and Aoe between the landing positions of the large droplets L and the small droplets N when the ink-jet head 22 is located at the outermost circumferential position, are 14 μm and 18 μm respectively. According to these results, it is appreciated that the distances between the landing positions of the large droplets L and the small droplets N when the disk drive 1 of the present embodiment is used, are substantially equal regardless of the positions in the optical disk D.

As described above, in the disk drive of the present embodiment, the distances between the landing positions of the large droplets L and the small droplets N are substantially equal regardless of the positions in the optical disk D, thus noises on an image to be printed can be reduced and the quality of the image can be improved.

In addition, in the disk drive 1 (recording apparatus) of the present embodiment, the number of ejection times of the nozzles can be adjusted in accordance with the position of the radius of the ink-jet head 22, in order to equalize the color density of an image to be recorded on the image recording surface of the optical disk D. Accordingly, the landing amount of the ink per unit area on the image recording surface of the optical disk D can be made constant to equalize the color density. Specifically, for the nozzles are located toward the inner circumferential side of the optical disk D, the number of ejection times becomes smaller (the number of ejection times are thinned out). When ink droplets having different volumes (for example, large droplet, small droplet or the like) are simultaneously ejected to perform gradation of the droplets, the size of each of the droplets may be adjusted so that the landing amount of ink per unit area on the image recording surface becomes constant.

The above embodiment has described the apparatus for recording an image while keeping the rotation speed (angular speed) of the optical disk constant. However, the present invention is not limited to this embodiment, and thus can be applied to a case in which the rotation speed of the optical disk is changed in accordance with the position of the radius of the ink-jet head and the linear speed is made constant (a case in which the optical disk is subjected to CLV control, for example). In this case, for example, noises, color shading and the like on an image can be prevented by adjusting the speed of an ink droplet, ejection timing, and the like in accordance with the position of the radius of the ink-jet head.

According to the embodiment described above, the ejection ports of the nozzles 27 formed on the ink ejection surface 26 of the ink-jet head 22 are disposed toward the outer side from the rotational center of the optical disk D, i.e. the ejection ports are disposed such that the distance between the ejection ports and the image recording surface Da of the optical disk D becomes shorter toward the outer edge of the optical disk D, thus the distance between the landing positions of the main droplet M and the satellite droplet S becomes substantially constant regardless of the positions in the optical disk D, whereby the quality of an image recorded onto the image recording surface Da is improved.

In this case, the ejection ports of the plurality of nozzles 27 are formed on the flat ink ejection surface 26 of the ink-jet head 22. Therefore, the ejection ports of the plurality of nozzles 27 can be easily arranged such that the distance between the ink ejection surface 26 and the image recording surface Da becomes shorter toward the outer side from the rotational center of the optical disk D by inclining the ink ejection surface 26 to the image recording surface Da so that the distance between the ink ejection surface 26 and the image recording surface Da becomes shorter toward the outer edge of the optical disk D.

Furthermore, the ink ejection surface 26 of the ink-jet head 22 is disposed parallel to the guide axes 23. Therefore, the ink ejection surface 26 can be easily inclined to the image recording surface Da by inclining the guide axes 23 to the image recording surface Da so that the distance between the guide axes 23 and the image recording surface Da becomes shorter toward the outer side from the rotational center of the optical disk D.

In the case where the large droplet L and the small droplet N are selectively ejected form the nozzles 27 of the ink-jet head 22 to perform droplet gradation, the distance between the nozzles 27 and the image recording surface Da becomes shorter toward the outer side from the rotational center of the optical disk D, thus the distance between the landing positions of the large droplet L and small droplet N becomes substantially constant regardless of the positions in the optical disk D, whereby noises on an image to be recorded on the image recording surface Da can be reduced and the quality of the image is improved.

Moreover, since the disk drive 1 includes the image recording apparatus 4 and the data recording apparatus 5, recording of an image onto the image recording surface Da of the optical disk D and recording of data onto the data recording surface Db can be performed with one apparatus. As described above, the ink-jet head 22 of the image recording apparatus 4 is disposed in the upper side of the image recording surface Da, the data-recording head 31 of the data recording apparatus 5 is disposed in the lower side of the data recording surface Db on the opposite side of the image recording surface Da, and the both are disposed so as to diagonally opposite to each other with respect to the center of the optical disk D, thus ink droplets ejected from the nozzles 27 hardly adhere to the data-recording head 31. Accordingly, the data-recording head 31 hardly breaks down.

Modified examples obtained by modifying the present embodiment in various ways are described next. However, same reference numerals are used to indicate the portions having the same configurations as the present embodiment, thus the overlapping explanations are omitted accordingly.

Figure 8:
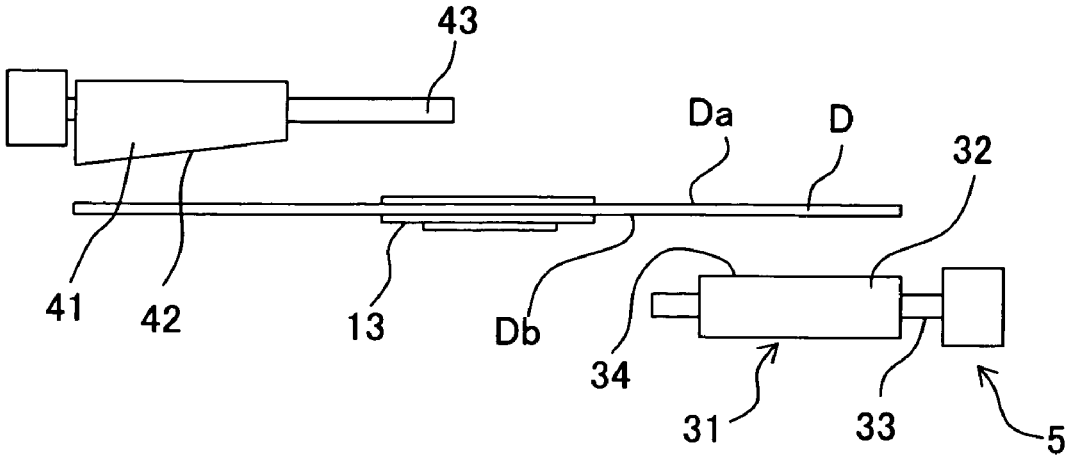
FIG. 8 is a side view showing the image recording apparatus and the data recording apparatus of a modified example 1.

As shown in FIG. 8, a guide axis 43 is disposed parallel to the image recording surface Da of the optical disk D. An ink ejection surface 42 of an ink-jet head 41 may be inclined to the image recording surface Da such that the distance between the ink ejection surface 42 and the image recording surface Da becomes shorter toward an outer circumference of the optical disk D (modified example 1). In this case as well, as in the above-described present embodiment, the distance between the ejection ports of the nozzles 27 provided on the ink ejection surface 42 and the image recording surface Da becomes shorter toward the outer side from the rotational center of the optical disk D, thus the distance between the landing positions of the main droplet M and satellite droplet S on the image recording surface Da can be made substantially constant regardless of the positions in the optical disk D, and further the distance between the landing positions of the large droplet L and small droplet N, which is obtained when droplet gradation is performed, can also be made substantially constant. Therefore, the quality of an image recorded on the image recording surface Da of the optical disk D can be improved.

In the abovementioned modified example 1, the positional relationship (distance) between the ink ejection surface 42 of the ink-jet head 41 and the image recording surface Da of the optical disk D is constant regardless of the position of the radius of the ink-jet head 41, thus the disk drive of the modified example 1 is suitable in the case of changing the rotation speed of the optical disk D in accordance with the position of the radius of the ink-jet head 41 to control the linear speed to be constant, and thereby recording an image (the case in which the optical disk is subjected to CLV control). Moreover, the disk drive of the modified example 1 can be applied to the case in which the rotation speed of the optical disk is kept constant to record an image (the case in which the optical disk is subjected to CAV control) as in the embodiment described above. In this case, for example, noises, color shading and the like on an image can be prevented by adjusting the speed of an ink droplet, ejection timing, and the like in accordance with the position of the radius of the ink-jet head 41.

Figure 9:
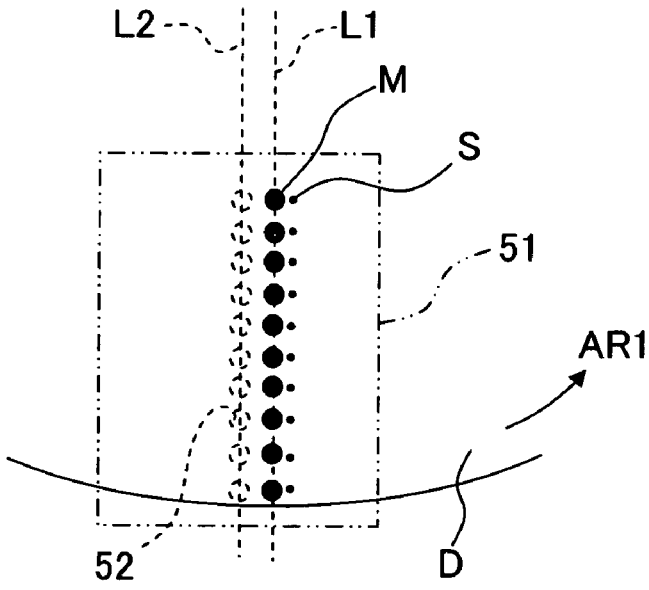
FIG. 9 is a plan view showing the image recording apparatus and the data recording apparatus of a modified example 2.

The plurality of nozzles formed on the ink ejection surface of the ink-jet head may be formed in a row at positions which are parallel to a straight line passing through the center of rotary drive of the rotary driving device and are displaced from the straight line (modified example 2). Specifically, as shown in FIG. 9, a plurality of nozzles 52 formed on an ink ejection surface of an ink-jet head 51 may be arranged in a row on a straight line L2, which is parallel to the straight line L1 indicating the radial direction of the optical disk Din a plan (the straight line passing through the center of rotary drive of the rotary driving device) and is displaced to the backward of a direction of rotation AR1 of the optical disk D (upstream side, and left side in FIG. 9). When the abovementioned ink ejection surface 26 is inclined to the image recording surface Da as in the above-described embodiment, the distance between the landing positions of ink droplets having different volumes can be made constant regardless of the positions in the optical disk D. However, when the plurality of nozzles 27 are arranged in a row along the radial direction of the optical disk D (when the nozzles are arranged on the straight line L1 shown in FIG. 9), a plurality of ink droplets simultaneously ejected from the plurality of nozzles 27 are arranged in the direction slightly away from the radial direction when landing onto the image recording surface Da (the ink droplets are arranged away from the straight line passing through the center of the optical disk D), thus there is a possibility that slight distortion is generated on an image to be recorded. On the other hand, as shown in FIG. 9, by displacing the positions of the nozzles 52 from the straight line L1 indicating the radial direction of the optical disk D, the main droplets M land along the straight line L1 parallel to the radial direction of the optical disk D, and the satellite droplets S also land on a position which is extremely close to the straight line L1. Accordingly, distortion on an image can be corrected, and the quality of an image to be recorded on the image recording surface Da can be further improved.

The carriage of the image recording apparatus may include a plurality of ink-jet heads for ejecting a plurality of color of ink droplets respectively, and these ink-jet heads may be arranged in a row from the inside toward the outside of the optical disk, i.e. toward the outer edge from the rotational center of the optical disk (modified example 3). For example, as shown in FIG. 10, four ink-jet heads 61 with a plurality of nozzles 62 (three of them are shown in FIG. 10) may be provided in the radial direction of the optical disk D in a carriage 60, and these four ink-jet heads 61 may be configured so as to eject ink droplets in colors of black (K), cyan (c), yellow (Y), and magenta (M) sequentially, starting from the ink-jet head disposed on the innermost side of the optical disk D.

A color image can be recorded on the image recording surface of the optical disk by using a plurality of colors of inks as above. However, when recording an image using the plurality of colors of inks, the distance between landing positions of ink droplets having different volumes changes in accordance with the positions in the optical disk D, color shading occurs on an image recorded on the image recording surface Da. In the recording apparatus of the present invention, however, the distance between the landing positions of ink droplets having different volumes on the image recording surface Da can be made substantially constant regardless of the positions in the optical disk D, as described above, thus the occurrence of such color shading can be prevented.

Figure 10:
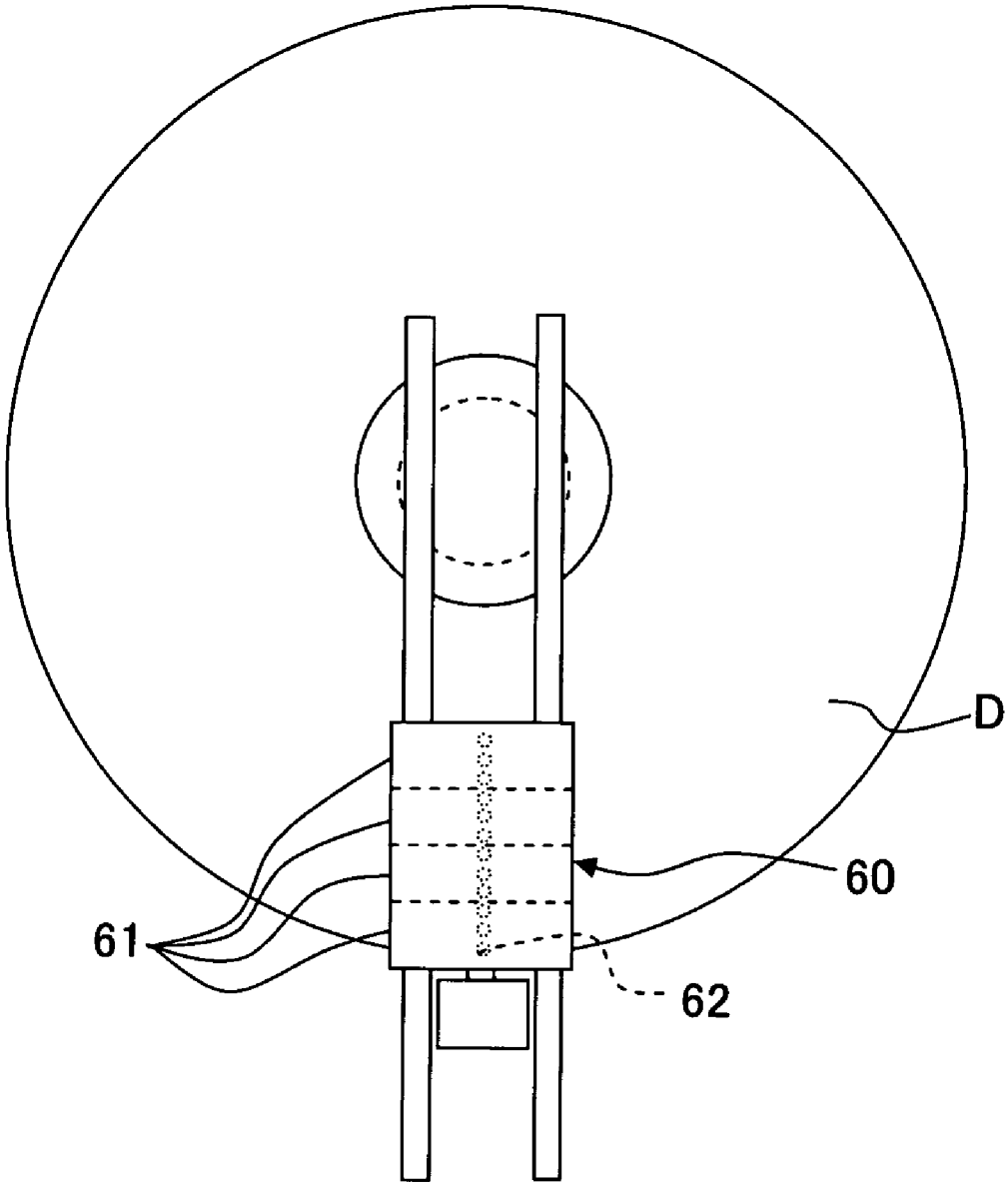
FIG. 10 is a plan view showing the image recording apparatus and the data recording apparatus of a modified example 3.
Figure 11:
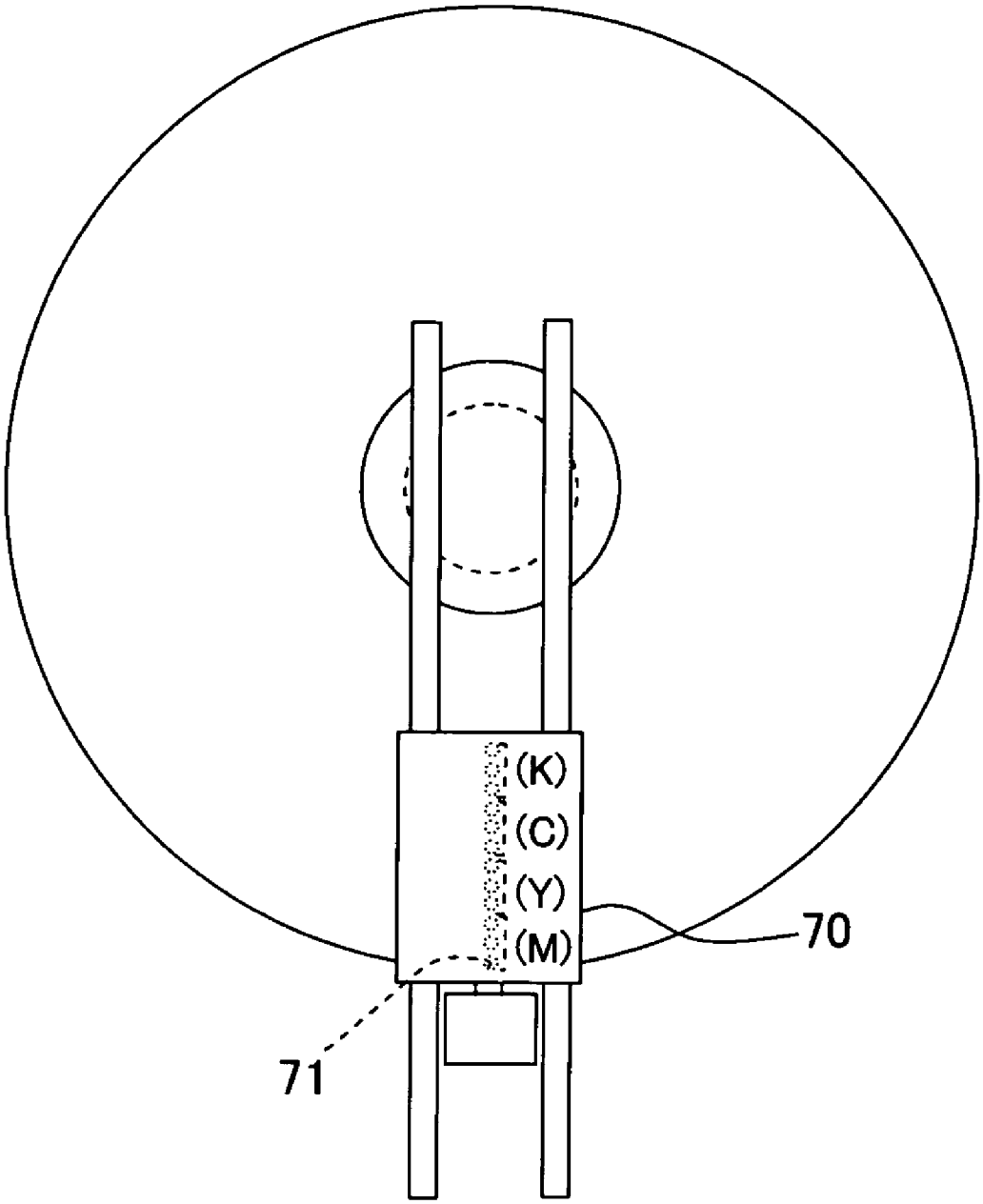
FIG. 11 is a plan view showing the image recording apparatus and the data recording apparatus of a modified example 4.

Moreover, the image recording apparatus for ejecting a plurality of colors of inks is not limited to the configuration provided with the plurality of ink-jet heads 61 as shown in FIG. 10. For example, as shown in FIG. 11, a plurality of nozzles 71 formed on an ink ejection surface of single ink-jet head 70 may be divided into four groups for ejecting four colors of ink droplets, i.e. black (K), cyan (C), yellow (Y), and magenta (M), and these four groups may be arranged in a row in this order of colors from the inside toward the outside of the optical disk D in the radial direction (modified example 4).

Figure 12:
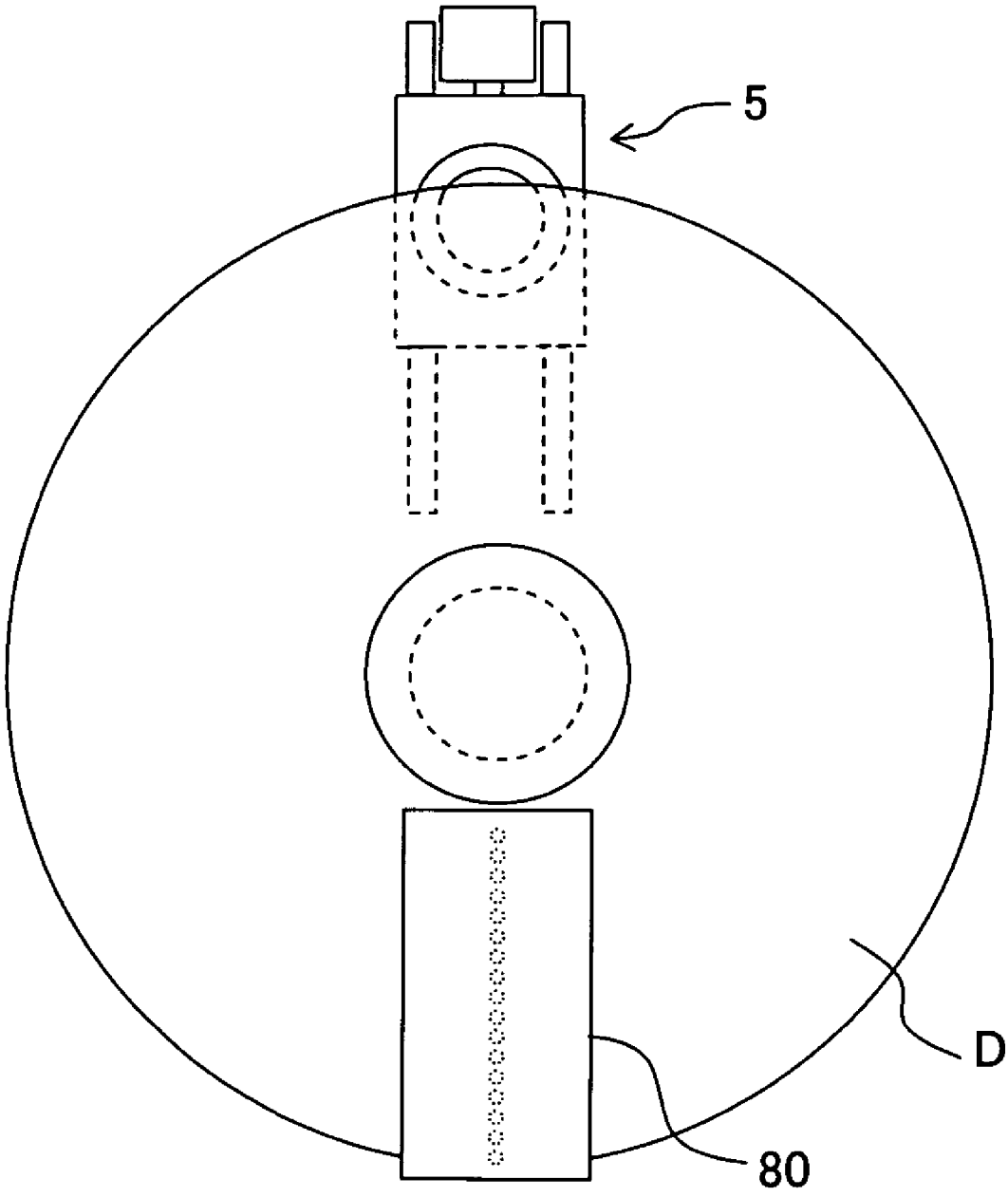
FIG. 12 is a plan view showing the image recording apparatus and the data recording apparatus of a modified example 5.

In the above description, the serial type ink-jet head has been described. However, the present invention is not limited to this, thus a line type ink-jet head 80 may be disposed in the upper side of the image recording surface Da of the optical disk D as shown in FIG. 12 (modified example 5). In this case, the ink-jet head 80 is disposed inclined to the image recording surface Da, and the distance between an ink ejection surface of the ink-jet head 80 and the image recording surface Da of the optical disk D may be allowed to be shorter toward the outer side from the center of the optical disk D.

Moreover, in the above description, the disk drive for recording an image onto the image recording surface Da of the circle optical disk D has been described. However, the present invention is not limited to this. For example, an image may be recorded onto a recording medium in a shape other than a circle having a flat image recording surface. Also, it is no necessary to provide the data recording apparatus 5.

Further, in the above description, the case in which the two types of ink droplets having different volumes are ejected from the nozzles, has been described. However, the present invention is not limited to this. Three types of ink droplets having different volumes may be ejected from the nozzles. Even in this case, the present invention is effective.

What is claimed is:

1. A recording apparatus which records an image on a recording medium having a flat image recording surface, the recording apparatus comprising:

a rotary driving device which rotationally drives the recording medium; and an ink-jet head which has a plurality of nozzles for ejecting ink onto the image recording surface of the recording medium, the nozzles having ejection ports, wherein the ejection ports are arranged such that a distance between the ejection ports of the plurality of nozzles and the image recording surface becomes shorter toward an outer side from a rotational center of the recording medium.

2. The recording apparatus according to claim 1, wherein the ink-jet head has a flat ink ejection surface on which the ejection ports of the plurality of nozzles are formed, and the ink ejection surface inclines to the image recording surface such that the distance between the ink ejection surface and the image recording surface becomes shorter toward the outer side from the rotational center of the recording medium.

3. The recording apparatus according to claim 2, further comprising a guide axis which supports the ink-jet head and extends from an inside of the recording medium toward an outside of the recording medium, wherein the ink-jet head is supported by the guide axis movably along an extending direction of the guide axis, and the guide axis inclines to the image recording surface such that the distance between the guide axis and the image recording surface becomes shorter toward the outer side from the rotational center of the recording medium.

4. The recording apparatus according to claim 3, wherein the guide axis inclines to the image recording surface of the recording medium by 0.3 degrees.

5. The recording apparatus according to claim 1, wherein the rotary driving device rotationally drives the recording medium at constant rotation speed.

6. The recording apparatus according to claim 1, wherein the plurality of nozzles are provided in a row parallel to a straight line passing through a center of rotational drive of the rotary driving device in a displaced position from the straight line.

7. The recording apparatus according to claim 1, wherein the ink-jet head selectively ejects droplets having different volumes from the nozzles.

8. The recording apparatus according to claim 1, comprising a plurality of ink-jet heads for ejecting a plurality of colors of inks respectively, wherein the plurality of ink-jet heads are arranged in a row from the inside of the recording medium toward the outside of the recording medium.

9. The recording apparatus according to claim 1, wherein the plurality of nozzles of the ink-jet heads are divided into a plurality of groups for ejecting mutually different colors of inks respectively, and the plurality of groups are arranged in a row from the inside of the recording medium toward the outside of the recording medium.

10. The recording apparatus according to claim 1, farther comprising a data-recording head for recording data onto a data recording surface which is formed on a side opposite to the image recording surface of the recording medium, wherein the ink-jet head and the data-recording head are disposed so as to be opposite to each other with the recording medium intervening therebetween.

* * * * *